US007604500B1

(12) United States Patent
Chen

(10) Patent No.: US 7,604,500 B1
(45) Date of Patent: Oct. 20, 2009

(54) BOARD-TO-BOARD CONNECTOR

(75) Inventor: Chung-Yu Chen, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/292,646

(22) Filed: Nov. 24, 2008

(51) Int. Cl.
*H01R 13/73* (2006.01)

(52) U.S. Cl. ..... 439/570; 439/566

(58) Field of Classification Search ..... 439/74, 439/570, 560, 567, 660
See application file for complete search history.

(56) References Cited

U.S. PATENT DOCUMENTS 5,626,482 A * 5/1997 Chan et al. ..... 439/74
5,704,807 A * 1/1998 Sherman et al. ..... 439/570
5,961,347 A * 10/1999 Hsu ..... 439/570
7,112,091 B2 * 9/2006 Okura et al. ..... 439/570
7,458,848 B2 * 12/2008 Nakano ..... 439/570

* cited by examiner

*Primary Examiner*—Hien Vu
(74) *Attorney, Agent, or Firm*—Rosenberg, Klein & Lee

(57) ABSTRACT

A board-to-board connector adapted for being soldered to a printed circuit board includes an insulating housing, two soldering members and a plurality of electrical terminals. The insulating housing has a base board and four sidewalls extending downward from the base board. Two ends of a top of the base board respectively define two fixing slots spaced away from each other. Each of the soldering members has a soldering plate disposed on the top of the base board for being soldered to the printed circuit board. Two opposite ends of the soldering plate bend downward and then extend to form a pair of fixing portions respectively fastened in the corresponding fixing slots. The electrical terminals are disposed in the insulating housing and located between the two soldering members for being soldered to the printed circuit board.

2 Claims, 4 Drawing Sheets

BOARD-TO-BOARD CONNECTOR

BACKGROUND OF THE INVENTION

1. Field of the Invention

The present invention generally relates to a board-to-board connector, and more particularly to a board-to-board connector capable of being soldered to a printed circuit board steadily.

2. The Related Art

Referring to FIG. 1, a conventional board-to-board connector 1' is shown. The board-to-board connector 1' includes an insulating housing 10', a plurality of electrical terminals 20' and four soldering members 30'. The insulating housing 10' is of a rectangular configuration and defines a plurality of terminal passageways 11' for receiving the respective electrical terminals 20' therein. The insulating housing 10' further defines four fixing slots 12' respectively located at four corners thereof. Each of the soldering members 30' has a fixing portion 31' fastened in the corresponding fixing slot 12', and two soldering foots 32' protruding upward from the fixing portion 31' and stretching out of a top of the respective fixing slot 12'. In use, the electrical terminals 20' are soldered to a printed circuit board (not shown) and the soldering foots 32' are also soldered to the printed circuit board so as to ensure the electrical terminals 20' electrically connect with the printed circuit board steadily.

However, the soldering member 30' is soldered to the printed circuit board only via the two soldering foots 32' thereof that results in a small soldering area between the soldering member 30' and the printed circuit board. As a result, when the board-to-board connector 1' is worked for a long time, the soldering member 30' is apt to fall off the printed circuit board that will result in an unsteadily electrical connection between the electrical terminals 20' and the printed circuit board.

SUMMARY OF THE INVENTION

An object of the present invention is to provide a board-to-board connector adapted for being soldered to a printed circuit board. The board-to-board connector includes an insulating housing, two soldering members and a plurality of electrical terminals. The insulating housing has a base board and four sidewalls extending downward from the base board. Two ends of a top of the base board respectively define two fixing slots spaced away from each other. Each of the soldering members has a soldering plate disposed on the top of the base board for being soldered to the printed circuit board. Two opposite ends of the soldering plate bend downward and then extend to form a pair of fixing portions respectively fastened in the corresponding fixing slots. The electrical terminals are disposed in the insulating housing and located between the two soldering members for being soldered to the printed circuit board.

As described above, the soldering plate is designed instead of soldering foots of a conventional technology that makes the soldering area between the soldering member and the printed circuit board enlarged. Therefore, the soldering member can be firmly soldered to the printed circuit board via the soldering plate thereof that further ensures a steady electrical connection between the electrical terminals and the printed circuit board.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 2:
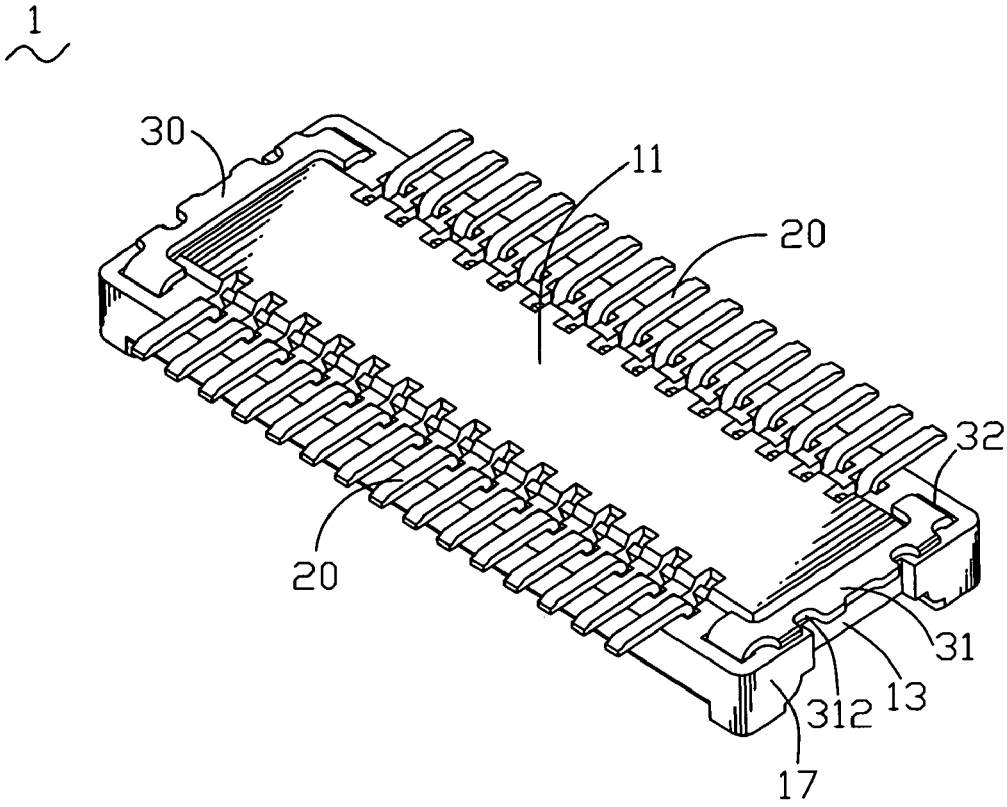
FIG. 2 is a perspective view of a board-to-board connector in accordance with the present invention.
Figure 3:
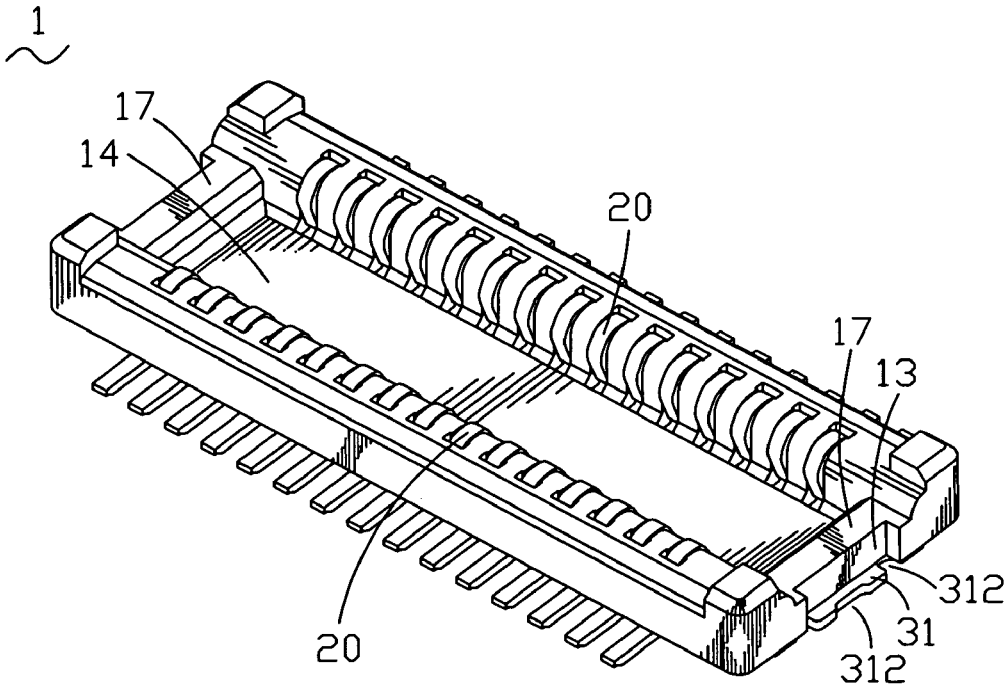
FIG. 3 is another angle perspective view of the board-to-board connector of FIG. 2.
Figure 4:
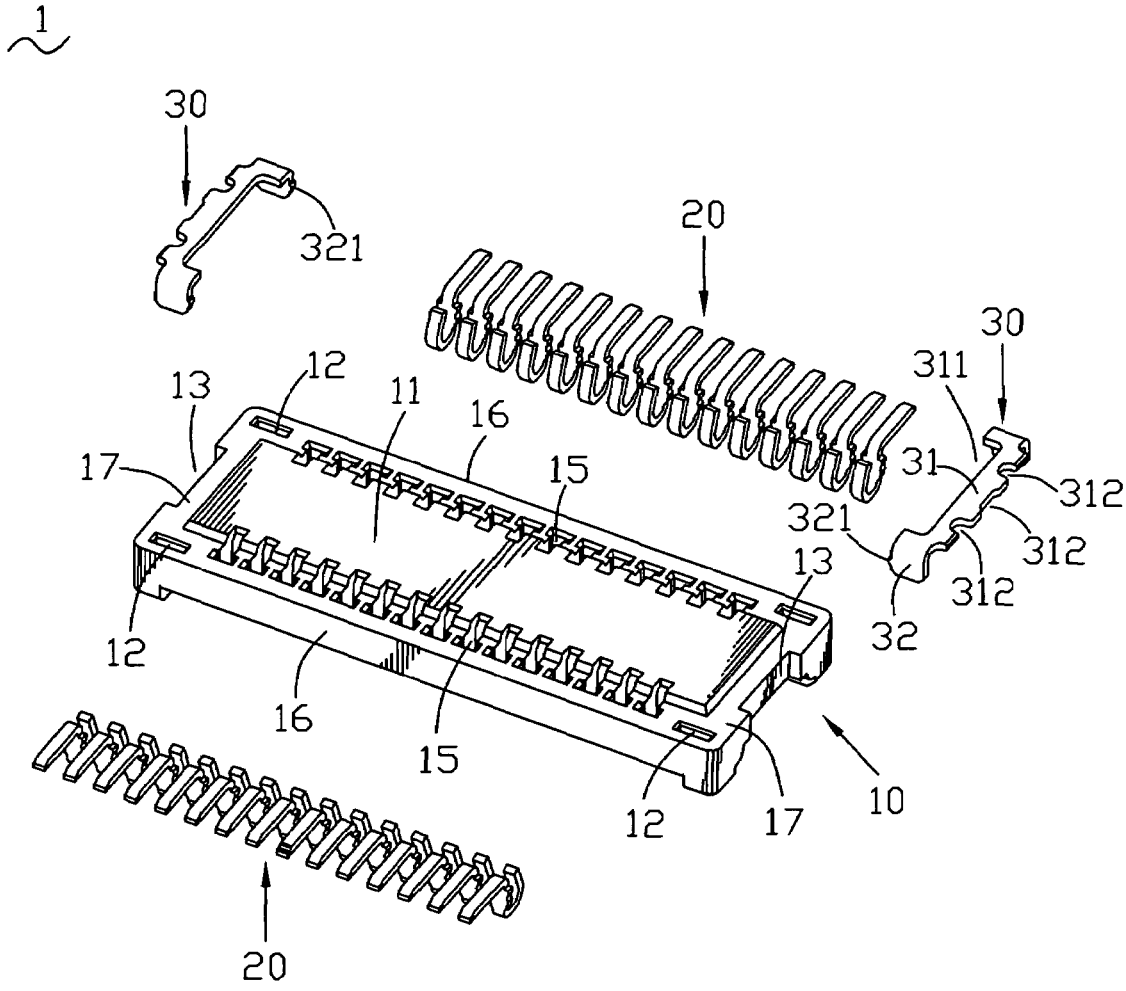
FIG. 4 is an exploded perspective view of the board-to-board connector of FIG. 2.

Referring to FIGS. 2-4, a board-to-board connector 1 in accordance with the present invention includes an insulating housing 10, a plurality of electrical terminals 20 and two soldering members 30 disposed in the insulating housing 10 respectively.

Figure 5:
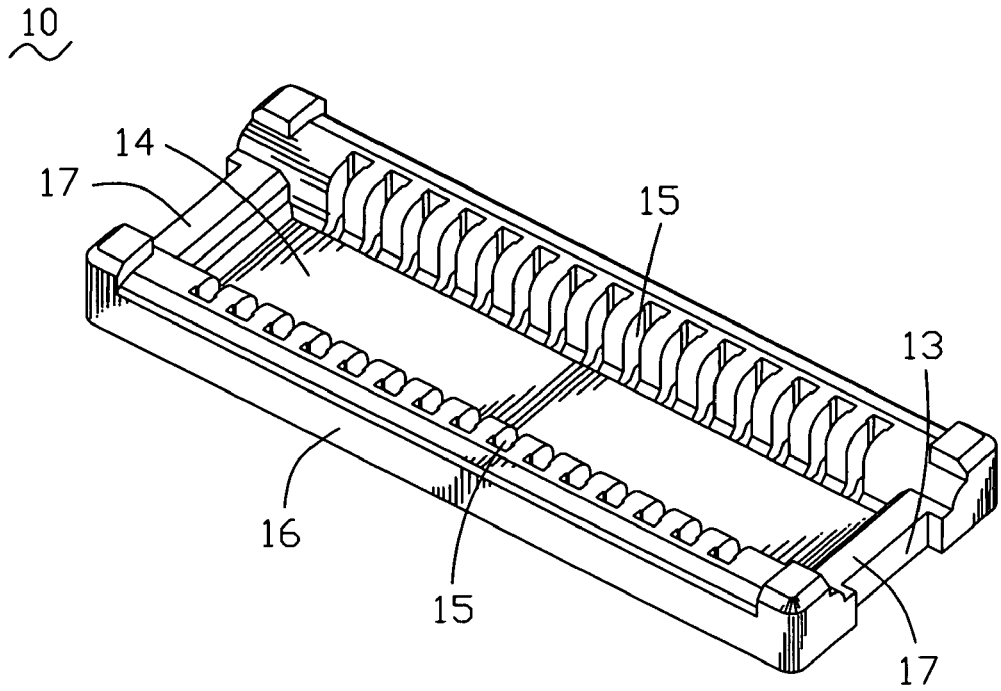
FIG. 5 is a perspective view of an insulating housing of the board-to-board connector of FIG. 2.

Referring to FIG. 4 and FIG. 5, the insulating housing 10 is of a rectangular configuration and has a flat base board 11. Two opposite sides of the base board 11 protrude downward to form a pair of first sidewalls 16 extending longwise. Two opposite ends of the base board 11 protrude downward to form a pair of second sidewalls 17. Accordingly, a rectangular receiving recess 14 is formed among the first sidewalls 16, the second sidewalls 17 and the base board 11. An inside of each of the first sidewalls 16 defines a plurality of terminal passageways 15 arranged at regular intervals along a longwise direction thereof. The terminal passageways 15 vertically penetrate through the respective first sidewalls 16 and communicate with the receiving recess 14. A middle of an outside of each of the second sidewalls 17 defines a rectangular gap 13 penetrating from top to bottom and extending longitudinally. Two ends of each second sidewall 17 respectively define a fixing slot 12 extending transversely at top.

Figure 6:
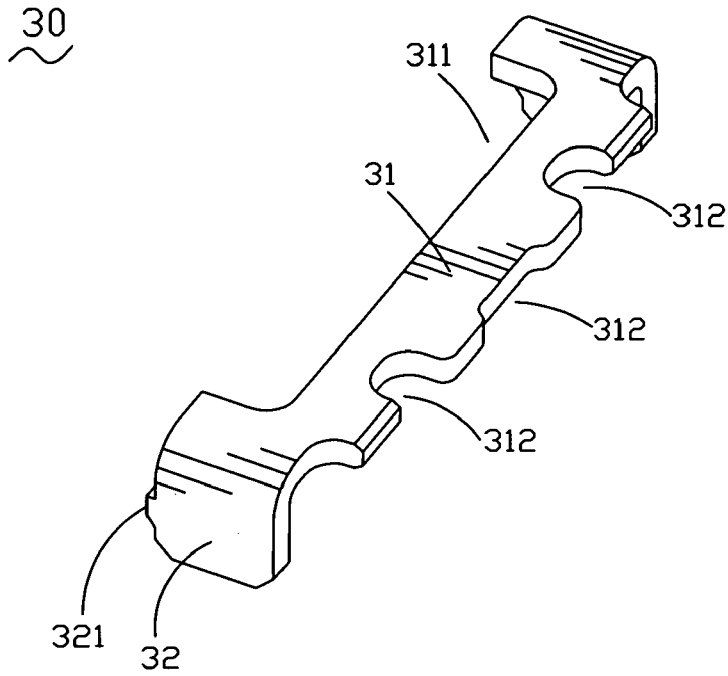
FIG. 6 is a perspective view of a soldering member of the board-to-board connector of FIG. 2.

Referring to FIG. 4 and FIG. 6, each of the soldering members 30 has a rectangular soldering plate 31 extending longitudinally. A middle of one side of the soldering plate 31 defines a rectangular fixing opening 311 extending longitudinally and penetrating from top to bottom. The other side of the soldering plate 31 defines three spillway cavities 312 vertically passing therethrough respectively, of which two are substantially semicircular at two ends and the other one is substantially rectangular in the middle. Two opposite ends of the soldering plate 31 bend downward and then extend to form a pair of fixing portions 32. A side of each fixing portion 32 protrudes outward to form a fixing lump 321.

Referring to FIGS. 2-4 again, when the board-to-board connector 1 is to be assembled, the electrical terminals 20 are respectively received in the corresponding terminal passageways 15 of the insulating housing 10. The two soldering members 30 are respectively disposed at two ends of the insulating housing 10. The soldering plate 31 of the soldering member 30 is disposed on the respective second sidewall 17 and partially covers the gap 13 to make the spillway cavities 312 communicate with the gap 13. The fixing opening 311 is buckled with an end portion of a top of the base board 11. The fixing portions 32 of the soldering member 30 are fastened in the respective fixing slots 12 and the fixing lump 321 abuts against an inside of the corresponding fixing slot 12 such that the soldering member 30 can be firmly fixed to the insulating housing 10. In use, the electrical terminals 20 are soldered to a printed circuit board (not shown) and the soldering plate 31 of the soldering member 30 is also soldered to the printed circuit board so as to ensure the electrical terminals 20 electrically connect with the printed circuit board steadily. In the process of soldering the soldering plate 31 to the printed circuit board, the soldering tin can flow through the spillway cavities 312 to a bottom of the soldering plate 31 for further soldering the soldering plate 31 firmly because of the spillway cavities 312 communicating with the gap 13. So the board-to-board connector 1 can be firmly soldered to the printed circuit board that ensures the electrical terminals 20 electrically connect with the printed circuit board steadily.

Figure 1:
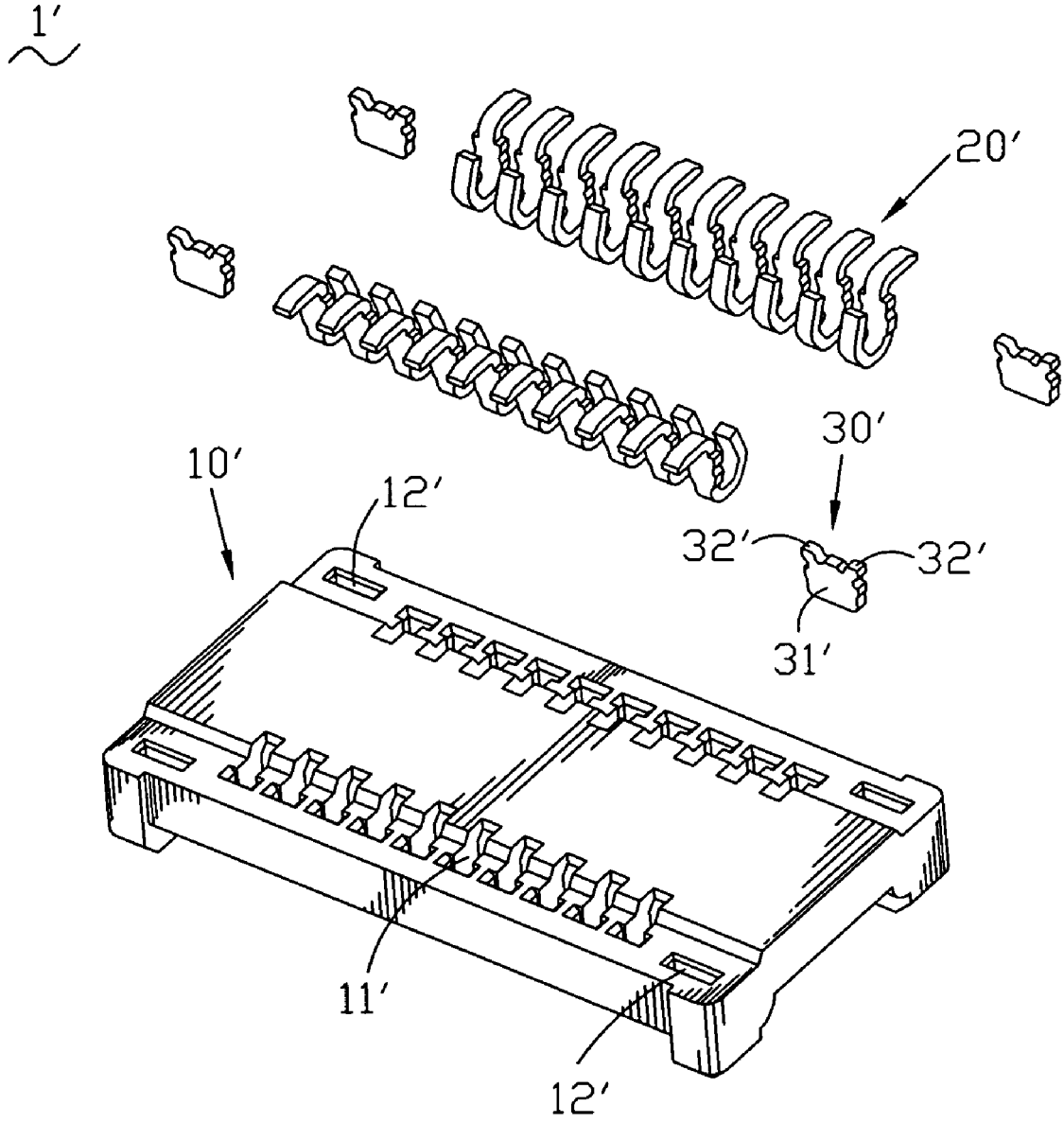
FIG. 1 (Prior Art)
FIG. 1 is an exploded perspective view of a conventional board-to-board connector.

As described above, the soldering plate 31 is designed instead of soldering foots 32' shown in FIG. 1 that makes the soldering area between the soldering member 30 and the printed circuit board enlarged. Therefore, the soldering member 30 can be firmly soldered to the printed circuit board via the soldering plate 31 thereof that further ensures a steadily electrical connection between the electrical terminals 20 and the printed circuit board.

What is claimed is:

1. A board-to-board connector adapted for being soldered to a printed circuit board, comprising:

an insulating housing having a base board and four sidewalls extending downward from the base board, two ends of a top of a first pair of the four sidewalls respectively defining two fixing slots spaced away from each other;

two U-shaped soldering members each respectively having a soldering plate disposed on the top of the first pair of sidewalls for being soldered to the printed circuit board, two opposite ends of the soldering plate extending inwardly and bending downwardly to form a pair of fixing portions respectively fastened in the corresponding fixing slots, each of the fixing portions protrudes outwardly to form at least one fixing lump abutting against an inside of a respective one of the fixing slots, an outside of each of a second pair of the four sidewalls defines a gap vertically passing therethrough, one side of the soldering plate covers the corresponding gap and defines a plurality of spillway cavities communicating with the corresponding gap; and a plurality of electrical terminals disposed in the insulating housing and located between the two soldering members for being soldered to the printed circuit board.

2. The board-to-board connector as claimed in claim 1, wherein the other side of the soldering plate defines a fixing opening buckled with the top of the base board.

* * * * *